United States Patent [19]

Ogden

[11] Patent Number: 4,600,183

[45] Date of Patent: Jul. 15, 1986

[54] BUILDING PANEL INSTALLATION DEVICE

[76] Inventor: James R. Ogden, Box 201, Papillion, Nebr. 68046

[21] Appl. No.: 685,456

[22] Filed: Dec. 24, 1984

[51] Int. Cl.[4] ..... B25B 5/14

[52] U.S. Cl. ..... 269/43; 269/904; 29/281.4

[58] Field of Search ..... 248/208, 236, 211, 214, 248/215, 247, 248, 235; 269/46, 904, 37, 43; 29/281.4; 33/180 R, 187, 188, 174 G

[56] References Cited

U.S. PATENT DOCUMENTS

| | | | |
|---|---|---|---|
| 961,018 | 6/1910 | Robb | 248/235 |
| 1,742,210 | 1/1930 | Lally | 248/214 |
| 2,491,638 | 12/1949 | Ayers . | |
| 2,524,875 | 10/1950 | Beaver | 248/211 |
| 2,674,429 | 4/1954 | Webster | 248/235 |
| 2,686,960 | 8/1954 | Leroy . | |
| 3,017,155 | 1/1962 | Scarpetti | 248/235 |
| 3,578,282 | 5/1971 | Olsen | 248/214 |
| 3,837,060 | 9/1974 | Stehling . | |
| 3,907,118 | 9/1975 | Pelavin | 248/214 |
| 3,914,871 | 10/1975 | Wolff . | |
| 4,059,248 | 11/1977 | Kuntz | 248/214 |
| 4,093,202 | 6/1978 | Kincaid . | |
| 4,159,029 | 6/1979 | Matthews | 269/904 |
| 4,164,346 | 8/1979 | Sickler | 269/904 |

*Primary Examiner*—Robert C. Watson

[57] ABSTRACT

A "Z-shaped" bracket which is removably hooked upon a horizontal structural member, for supporting exterior wall panels located above and adjacent to an opening in a building's wall. A plate hinged to the lower leg of the bracket is raised and lowered using a threaded rod projecting through the bracket's lower leg and under the free end of the plate. A lever attached to the lower end of the rod is used for rotating the rod.

17 Claims, 6 Drawing Figures

BUILDING PANEL INSTALLATION DEVICE

TECHNICAL FIELD

The present invention relates generally to removable building panel installation devices, and more particularly to device which have means for vertical adjustment of exterior wall panels supported thereon.

BACKGROUND ART

The construction industry has been plaqued by the troublesome task of aligning and installing heavy panels on the exterior of a building. Typically panels may be aligned on the ground, and those above are automatically aligned when stacked on top. The greatest problem is encountered on those panels which are hung directly above an opening in the exterior wall. For those panels, the task of plumbing and aligning is vastly more difficult.

The only structure known to the inventor for the installation of such panels requires cumbersome equipment and a great amount of time to align and mount each panel. First, a small scaffold is constructed on the interior of the building adjacent the window opening over which the panel is to be installed. Long boards are then affixed to the scaffold, cantilevered outwards to the exterior wall. A large counterweight is attached to the scaffold so that the boards will support the weight of a panel and men working on it. A panel is then hoisted by a crane and supported by the cantilevered boards in the approximate location for installation. The panel is then shimmed upwards and laterally as necessary using crow bars and wedge-shaped material inserted under the panel. Once a panel is installed the scaffold must be completely disassembled and moved to the next location after which the steps noted above are repeated.

It can therefore be seen that this process requires a great deal of time and several workmen to install each panel. The cost and time involved in installing a large number of these panels can have a major effect on the cost of the total project.

DISCLOSURE OF THE INVENTION

It is therefore a general object of the present invention to provide an improved device for holding a heavy panel in proper position for installation on a building.

Another object is to provide a building panel installation device which is easily transportable.

A further object of the present invention is to provide a panel installation device which does not have to be assembled or disassembled between uses.

More generally, it is an object of the present invention to provide a building panel supporting bracket with a bent portion which will removably hook over a horizontal member adjacent to the wall panel's desired location. A threaded rod, actuated by a lever, acts upon a hinged plate to adjust the vertical alignment of the panel. The horizontal member can be the angle iron which spans between adjacent columns which is used to support a soffit between the building and the lower edge of the panels.

These and other objects, advantages and novel features of the present invention will become apparent from the following detailed description of the invention when considered in conjunction with the accompanying drawings.

BEST MODE FOR CARRYING OUT THE INVENTION

Figure 1:
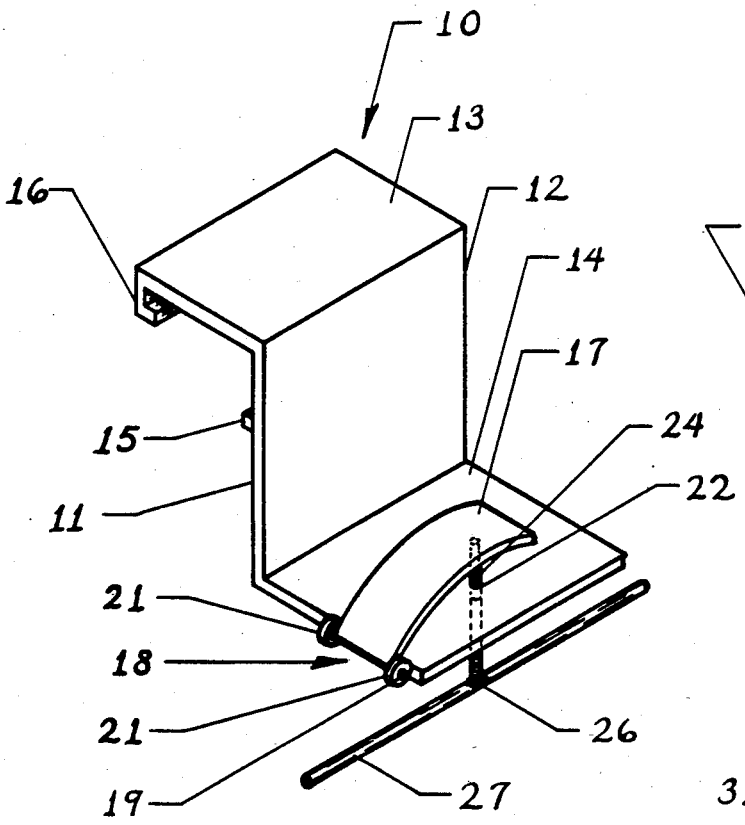
FIG. 1 is a perspective view of the invention.

Referring now to the drawings, in which identical or corresponding parts are indicated by the same reference character throughout the several views, and more particularly to FIG. 1, the building panel installation device is designated generally at 10.

Panel installation device 10 is comprised of a generally "Z-shaped" bracket 11, a hinged shim plate 17, and a threaded rod 24. It should be noted that wedge-shaped material could be used in lieu of hinged shim plate 17 (as described above in BACKGROUND ART). Bracket 11 has a vertical connecting member 12, an upper horizontal leg 13 and a lower horizontal leg 14. An "L-shaped" lip 16 depends from the free end of upper leg 13 to form a hook. A horizontal projecting band, 15 is located on the side of vertical connecting member 12 which faces lip 16. Band 15 is spaced away from upper leg 13.

Shim plate 17 is hinged at one end to an edge of lower leg 14 of bracket 11 and located generally under the desired position of a panel 23 when device 10 is positioned for use, as will be explained later. The hinge, designated generally at 18, is comprised of an elongated pin 19 and two ring-shaped bearings 21. Pin 19 is affixed along the edge of plate 17 and projects outwardly therefrom at each end. Bearings 21 are mounted in spaced axial relationship on an edge of lower leg 14, a distance apart slightly greater than the width of plate 17. Each extension of pin 19 rotates within one of the two ring-shaped bearings 21.

Figure 2:
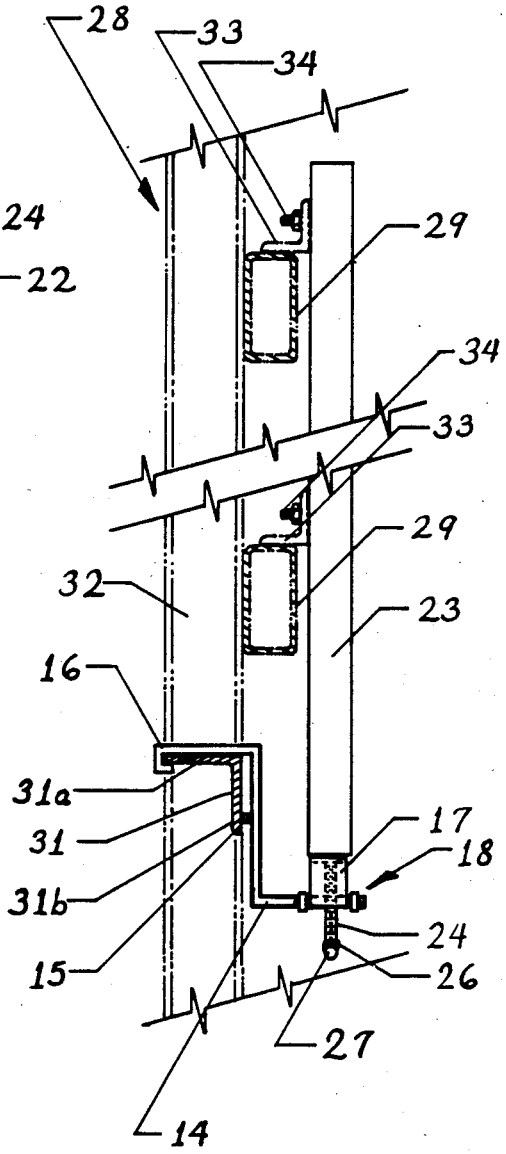
FIG. 2 is a side elevational view of the invention as it is used in installing a panel on a building.
Figure 3:
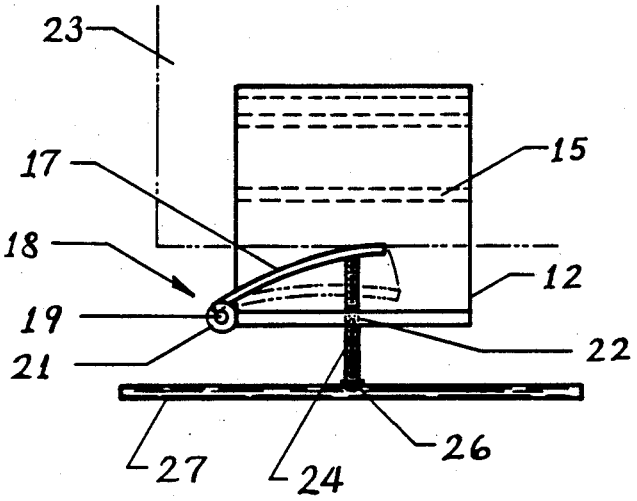
FIG. 3 is a front elevational view of the invention.

Referring additionally to FIGS. 2 and 3, a threaded aperture 22 is located centrally between the two lateral edges of lower leg 14, and centered under the width of plate 17. A rod 24, having threads corresponding with threaded aperture 22, has a lever 27 affixed to its end 26 which extends below lower leg 14 of bracket 11. Movement of lever 27 to rotate rod 24 within aperture 22 will thereby lengthen, or diminish the length of, the end of rod 24 which projects above lower leg 14. This action, in turn, will pivot plate 17 upwards or downwards about its hinge 18.

Shim plate 17 is arcuate beginning at its free end and flattening out towards its hinged end so that the area on the bottom of plate 17 which contacts the projecting end of rod 24 is maintained somewhat perpendicular to the longitudinal axis of rod 24 through angular changes of the contact point on plate 17. The arcuate shape of plate 17 also allows a larger contact area between the top of plate 17 and the bottom edge of panel 23, thus reducing the pressure created by its weight. Accordingly, the chance of indentations or damage to the bottom edge of panel 23 is reduced.

Referring now to FIG. 2, the structural framework of a building is designated generally at 28. A gridwork of ancillary members 29, conventional in the art for the support of exterior building panels 23, is affixed to structural framework 28. Slightly above each window or other opening piercing the exterior wall, an angle iron 31 is affixed between adjacent columns 32 of framework 28. Angle 31 supports a soffit (not shown) above the window opening and therefore will not be seen after the project is completed.

Angle 31 is affixed in position with one leg 31*a* horizontal and the other leg 31*b* depending vertically therefrom, the free end of horizontal leg 31*a* pointed towards the interior of the building. A panel installation device 10 is positioned onto angle 31 by hooking lip portion 16 of bracket 11 onto the free end of horizontal leg 31*a*, thereby hanging lower leg 14 below angle 31 and outward from the building. Projecting band 15 is located on connecting member 12 such that it will abut vertical leg 31*b* when a device 10 is installed upon angle 31. Band 15 will thus force the free end of horizontal leg 31*a* snugly into lip 16 of bracket 11, so that as weight is applied to lower leg 14 of the device 10, lip 16 will more firmly grip angle 31. It should be appreciated that device 10 is easily positioned on angle 31 since panel 23 will not be impeding its placement at this time. Also, angle 31 may be replaced with any type of horizontal member which has an edge similar to leg 31*a* of angle 31 upon which bracket 11 may be hooked.

During the installation of a panel 23, the inventor prefers to use two panel installation devices 10—one under each bottom corner of the panel 23—for better control in aligning and adjusting the panel 23. Panel 23 is hoisted up to devices 10 using a crane or other similar means. Shim plate 17 of each device 10 should be in a partially raised position when panel 23 is supported thereon, so that adjustment either upwards or downwards is possible.

Once panel 23 is supported on devices 10, it is loosely connected to ancillary members 29 using clips 33 and bolts 34 in a conventional manner such that adjustments may be made to panel 23 without removing bolts 34. Panel 23 is then shimmed vertically by turning lever 27 in the required direction, until panel 23 is level and at the proper height.

Panel 23 may also be shimmed in a direction perpendicular to the longitudinal axis of shim plate 17 (away from or closer to structural framework 28) by prying the bottom edge of the panel in the desired direction—panel 23 sliding on the top of shim plate 17. It should be noted that by hinging shim plate 17 as described above, the forces applied to shim plate 17 in this lateral shimming operation are resisted in the hinge 18. This protects rod 24 from having these forces applied directly to the projecting portion thereof, bending or otherwise damaging it. Similarly, any adjustment of panel 23 in a direction along the length of shim plate 17 would act upon hinge 18 rather than rod 24.

Once panel 23 is plumb it is affixed permanently in place by tightening bolts 34 in clips 33 and welding them in place. Panel holding devices 10 may now be removed for use in installing another panel 23.

Figure 6:
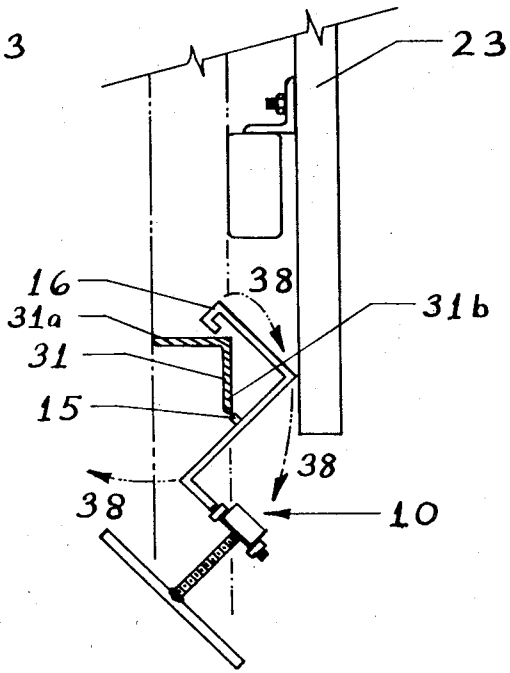
FIGS. 4, 5, and 6 are a series of side elevational views of the invention showing the manner in which the device is removed after a panel has been installed.
Figure 5:
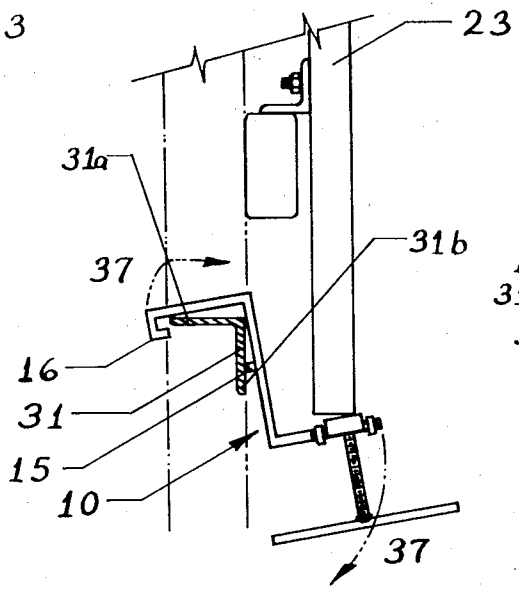
Figure 4:
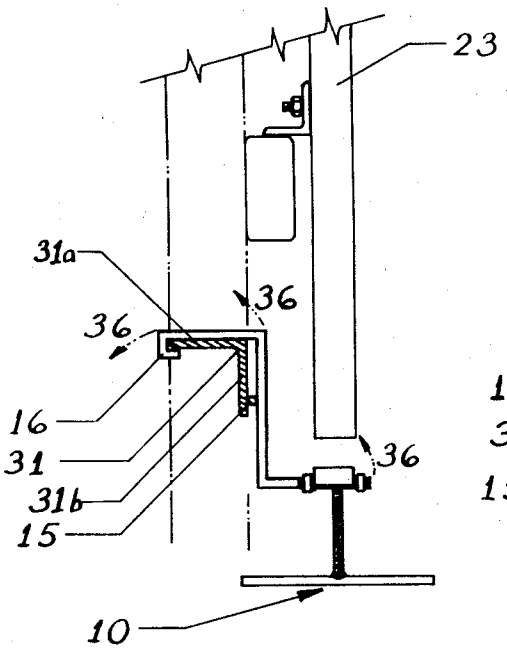

Referring to the series of FIGS. 4, 5 and 6, removal is accomplished by first lowering shim plate 17 to its bottom-most position. Bracket 11 is tilted slightly to unhook lip portion 16 from horizontal leg 31*a* of angle 31—the movement being shown by arrows 36 in FIG. 4. It can be seen that this tilting movement will be allowed because of the space between leg 31*b* of angle 31 and vertical connecting member 12 of bracket 11, created by projecting band 15. Thus band 15 is preferably located adjacent the free end of leg 31*b*, such that device 10 will tilt to the maximum degree (as shown in FIG. 5) to unhook lip 16 from angle 31. Bracket 11 is then tilted in the opposite direction, shown by arrows 37 in FIG. 5, to allow lip portion 16 to go over the top of angle 31 and slide down between angle 31. Finally, it will slide down between angle 31 and panel 23, as shown by arrows 28 in FIG. 6.

It can therefore be seen that any number of panels 23 may be supported and plumbed above a building opening by using two devices 10 which are consecutively positioned and removed from angles 31 by one man without any other tools. Device 10 may then be easily transported to the next location without assembly or disassembly.

It will be readily understood that the particular disposition or arrangement or nature of the elements of the invention are not of the essence of the invention, and that many variations, substitutions, and modifications may be made, in departure from the particular construction and characterization in the drawings and foregoing description, without departing from the true spirit of the invention. It is therefore to be understood that the invention should be limited only by the breadth and scope of the appended claims.

What is claimed is:

1. A building panel installation device, comprising:

a Z-shaped bracket having an upper horizontal leg, a lower horizontal leg for supporting the building panels, and a vertical connecting member therebetween;

a plate pivotally connected along one edge to an edge of the lower horizontal leg of said bracket, said plate projecting over the top of said lower leg;

a threaded rod engaged through a threaded aperture in said lower leg, said rod having a first end contacting the lower face of said plate and a second end projecting below said lower leg, whereby rotation of said rod will raise and lower the free end of said plate; and means for operably hooking said bracket to a horizontal structural member, said hooking means being affixed to the free end of the upper leg of said bracket, whereby the lower leg of said bracket will hang below and outwards from said horizontal member and support weight thereon.

2. The building panel installation device of claim 1, wherein said plate is arcuate from its pivotal edge to the free end thereof, the curve being flattened towards the hinged end, whereby the portion of the upper face of said plate directly above said rod will maintain a generally perpendicular relationship to said rod as said plate is pivoted.

3. The building panel installation device of claim 1, wherein said rod is positioned perpendicularly to said lower leg.

4. The building panel installation device of claim 1, further comprising a lever affixed to the second end of said rod for rotation thereof.

5. The building panel installation device of claim 2, wherein said rod is positioned perpendicularly to said lower leg.

6. The building panel installation device of claim 5, further comprising a lever affixed to the second end of said rod for rotation thereof.

7. A building panel installation device comprising:

a Z-shaped bracket having an upper horizontal leg, a lower horizontal leg for supporting the building panels, and a vertical connecting member therebetween;

an L-shaped lip depending from the free end of the upper leg of said bracket for hooking said bracket to a horizontal structural member, wherein the upper leg of said bracket extends a distance slightly greater than the depth of the horizontal structural member, and wherein said lip depends a distance slightly greater than the thickness of the horizontal structural member, whereby said bracket is hooked upon the horizontal structural member by operably hooking said lip portion over an edge of the horizontal structural member; and a projecting portion on a face of the connecting member of said bracket spaced away from the upper horizontal leg thereof and located so as to contact the horizontal structural member when said bracket is positioned thereon and force the edge of the horizontal structural member snugly into said L-shaped lip.

8. The building panel installation device of claim 7, further comprising means for adjusting the vertical alignment of the building panel.

9. The building panel installation device of claim 7, wherein said adjusting means includes:

a plate pivotally connected along one edge to an edge of the lower horizontal leg of said bracket, said plate projecting over the top of said lower leg; and a threaded rod engaged through a threaded aperture in said lower leg, said rod having a first end contacting the lower face of said plate and a second end projecting below said lower leg, whereby rotation of said rod will raise and lower the free end of said plate.

10. The building panel installation device of claim 9, wherein said plate is arcuate from its pivotal edge to the free end thereof, the curve being flattened towards the hinged end, whereby the portion of the upper face of said plate directly above said rod will maintain a generally perpendicular relationship to said rod as said plate is pivoted.

11. The building panel installation device of claim 9, wherein said rod is positioned perpendicularly to said lower leg.

12. The building panel installation device of claim 9, further comprising a lever affixed to the second end of said rod for rotation thereof.

13. A building panel installation device, comprising:

a Z-shaped bracket having an upper horizontal leg, a lower horizontal leg for supporting the building panels and a vertical connecting member therebetween; and an L-shaped lip depending from the free end of the upper leg of said bracket for hooking said bracket to a horizontal structural member, wherein the upper leg of said bracket extends a distance slightly greater than the depth of the horizontal structural member, and wherein said lip depends a distance slightly greater than the thickness of the horizontal structural member, whereby said bracket is hooked upon the horizontal structural member by operably hooking said lip portion over an edge thereof;

a plate pivotally connected along one edge to an edge of the lower horizontal leg of said bracket, said plate projecting over the top of said lower leg; and a threaded rod engaged through a threaded aperture in said lower leg, said rod having a first end contacting the lower face of said plate and a second end projecting below said lower leg, whereby rotation of said rod will raise and lower the free end of said plate.

14. The building panel installation device of claim 13, wherein said plate is arcuate from its pivotal edge to the free end thereof, the curve being flattened towards the hinged end, whereby the portion of the upper face of said plate directly above said rod will maintain a generally perpendicular relationship to said rod as said plate is pivoted.

15. The building panel installation device of claim 14, wherein said rod is positioned perpendicularly to said lower leg.

16. The building panel installation device of claim 15, further comprising a lever affixed to the second end of said rod for rotation thereof.

17. The building panel installation device of claim 16, further comprising a projecting portion on a face of the connecting member of said bracket spaced away from the upper horizontal leg thereof and located so as to contact said angle iron when said bracket is positioned thereon, whereby said projecting portion will force said angle iron snugly into said hooking means.

* * * * *